US006244197B1

(12) United States Patent
Coble

(10) Patent No.: US 6,244,197 B1
(45) Date of Patent: Jun. 12, 2001

(54) THERMAL INDUCED COOLING OF INDUSTRIAL FURNACE COMPONENTS

(76) Inventor: Gary L. Coble, RD #2, Box 214, DuBois, PA (US) 15801

( * ) Notice: Subject to any disclaimer, the term of this patent is extended or adjusted under 35 U.S.C. 154(b) by 0 days.

(21) Appl. No.: 09/476,271

(22) Filed: Jan. 3, 2000

Related U.S. Application Data

(60) Provisional application No. 60/114,603, filed on Jan. 4, 1999.

(51) Int. Cl.[7] ..... F23M 5/06; F23M 5/08; F28D 1/06; B22D 19/00

(52) U.S. Cl. ..... 110/332; 110/314; 110/336; 110/337; 110/338; 110/180; 165/73; 165/128; 249/83

(58) Field of Search ..... 110/314, 338, 110/336, 337, 332, 331, 323, 322, 324, 325, 326, 173 R, 175 R, 181, 180, 182, 182.5; 165/73, 128; 249/83

(56) References Cited

U.S. PATENT DOCUMENTS

| | | | | |
|---|---|---|---|---|
| 2,413,183 | * | 12/1946 | Hosbein | 72/101 |
| 2,859,270 | * | 11/1958 | Patchin | 174/16 |
| 3,314,668 | | 4/1967 | Rosenak | 266/32 |
| 3,580,331 | | 5/1971 | Wargo | 165/48 |
| 3,652,070 | | 3/1972 | Sagara | 266/32 |
| 3,829,595 | | 8/1974 | Nanjyo et al. | 13/32 |
| 4,079,184 | | 3/1978 | Bahout et al. | 13/32 |
| 4,132,852 | | 1/1979 | Andoniev et al. | 13/32 |
| 4,162,061 | | 7/1979 | Buhler et al. | 266/193 |
| 4,221,922 | | 9/1980 | Okimune | 13/32 |
| 4,335,870 | | 6/1982 | Diener et al. | 266/193 |
| 4,414,674 | | 11/1983 | Woodruff et al. | 373/130 |
| 4,434,495 | * | 2/1984 | Tomizawa et al. | 373/76 |
| 4,534,319 | * | 8/1985 | Manno | 122/15 |
| 4,636,325 | * | 1/1987 | Greene | 252/75 |
| 4,671,191 | * | 6/1987 | Schwalb | 110/336 |
| 4,716,857 | * | 1/1988 | Moreau | 122/6 A |
| 4,740,018 | * | 4/1988 | Kenmochi | 285/150 |
| 5,142,999 | | 9/1992 | Etemad et al. | 110/235 |
| 5,216,886 | * | 6/1993 | Ewing | 60/752 |
| 5,230,617 | | 7/1993 | Klein et al. | 432/233 |
| 5,234,660 | | 8/1993 | Simko, Jr. | 266/286 |
| 5,289,495 | | 2/1994 | Johnson | 373/74 |
| 5,323,484 | | 6/1994 | Nakao et al. | 392/416 |

(List continued on next page.)

*Primary Examiner*—Denise L. Ferensic
*Assistant Examiner*—K. B. Rinehart
(74) *Attorney, Agent, or Firm*—David A. Burge

(57) ABSTRACT

Chimney-like cooling passages that have opposite outlet and inlet end regions open to ambient air also have central regions that extend through heated components of industrial furnaces. The passages preferably are defined by conduits that are oriented and configured in a manner that enables thermally induced flows of ambient air to self establish through the conduits to cool the furnace components once the furnace components become heated. The passages function like chimneys, with each having its outlet located higher than its inlet so that ambient air will effectively rise as it flows from the inlet to the outlet. The passages may provide increases in cross-sectional area somewhere along their lengths so that heated ambient air expanding in the passages is encouraged to discharge from the less restrictive, larger area outlets rather than from the smaller area inlets. If the passages are defined by conduits formed from high heat resistant metal such as stainless steel, and if the conduits have central regions that are embedded in furnace components formed from cast refractory materials, end regions of the conduits may be connected to a framework that supports the cast refractory components, whereby the conduits serve both to cool and to mount the cast refractory components on the framework.

60 Claims, 10 Drawing Sheets

U.S. PATENT DOCUMENTS

| | | | |
|---|---|---|---|
| 5,332,116 | 7/1994 | Nutter et al. | 220/215 |
| 5,335,897 | 8/1994 | Coble | 266/286 |
| 5,483,548 | 1/1996 | Coble | 375/75 |
| 5,562,879 | 10/1996 | Coble | 266/252 |
| 5,575,970 | 11/1996 | Coble | 266/44 |
| 5,578,264 | 11/1996 | Coble | 266/263 |
| 5,681,525 | 10/1997 | Coble | 266/44 |
| 5,707,230 | 1/1998 | Kiss | 432/238 |
| 5,756,043 | 5/1998 | Coble | 266/44 |
| 5,785,517 * | 7/1998 | Gray et al. | 432/252 |

* cited by examiner

THERMAL INDUCED COOLING OF INDUSTRIAL FURNACE COMPONENTS

REFERENCE TO PROVISIONAL APPLICATION

This application claims the benefit of U.S. Provisional Application Serial No. 60/114,603 entitled THERMAL INDUCED COOLING OF INDUSTRIAL FURNACE COMPONENTS filed Jan. 4, 1999 by Gary L. Coble, the disclosure of which is incorporated herein by reference.

BACKGROUND OF THE INVENTION

1. Field of the Invention

The present invention relates to walls, doors, lids, covers and other elements of industrial furnaces and the like that are formed from components subjected to high heat during use that are provided with chimney-like internal passages through which flows of ambient air are induced to circulate without being blown, pressurized or otherwise forced to flow, to perform a cooling function. Stated in another way, the present invention relates to methods and means for providing cooling flows of ambient air that self establish through interior regions of heated components of industrial furnaces and the like, by providing elongate chimney-like passages that extend internally through the heated components, with the passages defining inlets and outlets near opposite end regions thereof that communicate with a body of ambient air, and with the outlet of each passage being located higher than the inlet so that ambient air 1) may enter the inlet, 2) may become heated and rise in the chimney-like passage as the ambient air is exposed to the hot interior of at least one of the heated components, and 3) may discharge through the outlet so as to carry heat energy away from the interior of at least one of the heated components. The outlet end regions of the passages may be of greater cross-sectional area than the inlet end regions to encourage ambient air that becomes heated and expands within the chimney-like passages to discharge from outlets that are less restrictive than the inlets. If the passages are defined by conduits made from high heat resistant metal such as stainless steel, and if the conduits have central regions that are embedded within furnace components formed from cast refractory material, conduit end regions that project from the cast refractory components may be connected to a supporting framework, by which arrangement the conduits serve not only to cool the cast refractory components but also to mount the cast refractory components on the framework.

2. Prior Art

Industrial furnaces are well known that employ wall, door, lid and cover components that will provide improved service longevity if they are cooled during use to minimize the detrimental effects of a high heat environment. While efforts have been made to provide such components with coolant tubes through which flows of coolant (such as water or refrigerant) may be circulated by means of pumps, blowers, compressors and the like, these forced flow coolant systems have many drawbacks including complexity, high cost, and the need for active programs of maintenance to ensure that coolant circulates properly at times when the components are subjected to high heat.

Many components that are subjected to high heat (such as components that are used in forming walls, doors, lids and covers of industrial furnaces and the like) can be formed advantageously from castable refractory material. Normally castable refractory furnace components are held in place with the aid of metallic anchors that are positioned and oriented to favor (i.e., positioned near and/or extending toward) the cold face of the refractory components to ensure that the anchors remain as cool as possible. While these metallic anchors often are formed from stainless steel (to provide reasonably priced anchors that will offer relatively good resistance to high heat), the failure of these anchors in refractory systems that are exposed to high heat temperatures as high as 2800 to 3100 degrees Fahrenheit is quite common.

The complex nature of forced coolant flow systems that employ fans, pumps, blowers, or compressors together with coolant reservoirs and interconnecting coolant supply lines renders the use of forced flows of circulating coolant impractical and unworkable with many types of industrial furnace components. Thus, a long-standing need has existed for a much simpler method and means for cooling heated components of industrial furnaces and the like to lengthen the service life of these furnace components by permitting these components (and metallic elements that are embedded within many of these components) to operate at cooler temperatures.

The applicant, Gary L. Coble, is the named inventor in several patents that feature related subject matter. While many patents disclose industrial furnace components of a type that would benefit from the provision of a simple cooling method and means, U.S. Pat. Nos. 5,335,897 and 5,483,548 issued to Gary L. Coble provide good examples thereof, hence the disclosures of these patents are incorporated herein by reference. The manner in which cast refractory components are made and put to use in the bases of annealing furnaces is disclosed in U.S. Pat. Nos. 5,562,879, 5,575,970, 5,578,264, 5,681,525 and 5,756,043 issued to Gary L. Coble, and the disclosures of these patents also are incorporated herein by reference.

SUMMARY OF THE INVENTION

In accordance with the preferred practice of the present invention, chimney-like passages are used to duct flows of ambient air through interior regions of heated components of industrial furnaces and the like to cool the components, typically to improve service longevity of the components and of metal structures that may be embedded within these components. The passages are oriented and configured so that cooling flows of ambient air self establish within the passages once the furnace components are heated to temperatures significantly higher than ambient air temperatures, without a need employ fans, pumps, blowers, compressors or other complex paraphernalia characteristically found in forced flow coolant systems.

In accordance with one form of preferred practice, a component of an industrial furnace or the like is cooled 1) by providing at least one passage through a selected interior region of the component, namely a elongate passage that extends continuously between spaced openings located near opposite ends of the passage, and 2) by positioning the component so that, when the component becomes heated during normal service (due, for example, to operation of the furnace or the like), the spaced openings communicate with a body of ambient air, with at least one of the openings defining an inlet that is located below at least another one of the openings which defines an outlet, so that ambient air may enter the inlet, may become heated and rise within the passage (just as heated expanding gas rises in a chimney), and may discharge from the outlet to thereby establish a flow of ambient air through the passage to cool the component.

If a passage is provided with more than one inlet or more than one outlet, all of the outlets should be located above the highest one of the inlets to ensure that heated ambient air enters the passage through the inlet(s) and discharges through the outlet(s).

While, in most installations, it is preferred that the cross-sectional area of the outlet of a passage not be less than the cross-sectional area of the inlet of the passage, there may be some installations wherein the outlet is located so much higher than the inlet that a smaller area outlet than inlet can be tolerated. In many installations, however, it is preferred that the cross-sectional area of the outlet of a passage be at least about ten percent larger than the cross-sectional area of the inlet of the passage so that, as ambient air becomes heated and expands within the passage, it will be encouraged to discharge through the less restrictive, larger area outlet than through the smaller area inlet.

The preferred way of providing an outlet that is of larger cross-sectional area than the associated inlet is to provide the passage with an increase in cross-sectional area somewhere along a central region of the passage (i.e., between opposite end regions of the passage). The increase in cross-sectional area can be provided at a specific location along the length of a passage, or at a plurality of locations along the length of a passage, or may be defined by one or more tapered regions of the passage so that the increase in area is gradual rather than immediate.

In preferred practice, the way in which an increase in cross-sectional area is achieved is to use a larger diameter conduit to form the outlet end region of a passage than is used to form the inlet end region—with a welded juncture of the differently sized conduits being provided in a central region of the passage. In preferred practice, a coupling configured to internally receive portions of each of the conduits is welded to each of the conduits to assist in defining a secure juncture between the two conduits.

If a passage is provided with more than one inlet or more than one outlet, the combined cross-sectional area of the outlet(s) should exceed the combined cross-sectional area of the inlet(s) if the advantage of encouraging heated expanding ambient air to discharge from a less restrictive, larger area outlet is to be achieved. One way of achieving both an increase in cross-sectional area along the length of a passage and of providing the passage with a plurality of outlets is to give the passage a Y-shaped configuration, with the stem of the "Y" defining the inlet, and with the branches of the Y defining a pair of outlets. Other branched and interconnected arrangements of passages will occur to those who are skilled in the art.

Quite an interesting aspect of the invention resides in the discovery that passages can be designed having inlets lower than outlets for cooling components positioned in a large variety or orientations. Stated in another way, features of the invention are not limited to the use of passages having vertically extending central regions that are used to cool vertically extending components. Indeed, passages having inclined central regions can be used to cool components that are inclined relative to the vertical, and passages having horizontally extending central regions even can be used to cool components that extend horizontally—so long as passage outlets are positioned above passage inlets. In installations where central regions of the cooling passages extend horizontally or almost horizontally, it can prove useful to include increases in cross-sectional area along central regions of the passages to assist in establishing and maintaining properly oriented air flows, especially in situations where the difference in height between the outlet and the inlet is relatively small.

While U-shaped passages that open through a common cold face of a cast refractory component of an industrial furnace represents the preferred practice of the present invention, the outlet(s) and inlet(s) of a passage do not all need to open through a common face of a component in order to function properly. Indeed, a vertical component can be cooled by a passage that opens through opposite ends of the component to define a downwardly facing inlet and an upwardly facing outlet; or one or more of the inlet and outlet openings may open downwardly or upwardly as just described, while another or more of the inlet and outlet openings may open horizontally through a vertically extending cold face of the component. Other arrangements of inlet and outlet openings will occur to those who are skilled in the art.

Special advantages are achieved when the present invention is used with heated components of industrial furnaces and the like that are formed from cast refractory material, where the cooling passages are defined by conduits formed from high heat resistant metal such as stainless steel, where central regions of the conduits are embedded in the cast refractory components, and where end regions of the conduits project out of the cast refractory and are connected to a supporting framework. By this arrangement, the conduits not only serve to cool the cast refractory components (and other metal members such as anchors that may reside within the cast refractory at locations near the embedded central regions of the conduits) but also provide self-cooled mounts that offer excellent service longevity.

Thus, while a principal purpose of the chimney-like metal conduits (representing the preferred practice of the present invention) is to effect cooling (so that, for example, the cast refractory and other metal structures embedded in the cast refractory can function at lower temperatures than would otherwise prevail so that their service longevity is enhanced), an auxiliary use that can be made of these chimney-like metal conduits is to use them to support the cast refractory components, for example by connecting projecting end regions of the conduits to a supporting framework to thereby mount the cast refractory components on the framework.

A significant feature of the present invention is that, in addition to being quite simple, it functions quite unexpectedly well when used to cool castable refractory components and adjacent metallic components embedded therewithin. Tests have shown, for example, that regions of cast refractory components wherein metallic anchor members are embedded—regions that normally will sustain an operating temperature of about 1500 degrees Fahrenheit when interior surfaces of the cast refractory are exposed to hot metal temperatures of about 2800 degrees Fahrenheit to about 3200 degrees Fahrenheit—can be maintained at about 1200 degrees Fahrenheit by employing applicant's chimney-like conduits. While 1500 degrees Fahrenheit exceeds the acceptable normal environment temperature at which stainless steel anchors can be expected to perform reliably for service lives of reasonable duration, 1200 degrees Fahrenheit is an acceptable normal environment temperature, at which stainless steel anchors will provide lengthy service.

Tests also have shown that as the internal temperature of the furnace components being cooled increases (relative to the temperature of ambient air, which remains substantially constant), the chimney-like conduits of the present invention are found to exhibit a corresponding increase in rate at which ambient air is induced to flow therethrough—whereby, as a need for increased cooling is encountered, the higher flow rates of ambient air provide a means for carrying away increasingly greater quantities of heat energy. Thus, not only does the present invention provide a cooling system that is highly reliable from the viewpoint that it offers no moving parts to break down, it also provides a cooling system that self-starts when needed, and that becomes more effective when increased demands are placed upon it.

A further feature of the present invention resides in the relatively wide range of industrial furnace applications (and the like) wherein chimney-like conduits for establishing thermally induced flows of ambient air to effect cooling are quite well suited for use. In the accompanying drawings, for example, components of furnace doors, walls, lids and covers are depicted that all employ substantially the same kinds of chimney-like conduits that are generally of U-shape, having outlets of larger diameter than their inlets, having outlets positioned higher than their inlets, and provided with increases in diameter at locations between their inlets and outlets—with some of these applications also illustrating how the chimney-like conduits may be positioned to cool embedded metallic structures such as anchor devices. A number of these applications also show how the chimney-like conduits may be used to connect castable refractory components of industrial furnaces to support framework—to provide long-lived, self-cooled anchors for positioning and mounting these castable refractory components.

BRIEF DESCRIPTION OF THE DRAWINGS

These and other features, and a fuller understanding of the present invention may be had by referring to the following description and claims, taken in conjunction with the accompanying drawings, wherein:

FIG. 10 is a perspective view of still another form of industrial furnace component of a type typically utilized in a door or wall of an industrial furnace or the like;

DESCRIPTION OF THE PREFERRED EMBODIMENT

Figure 1:
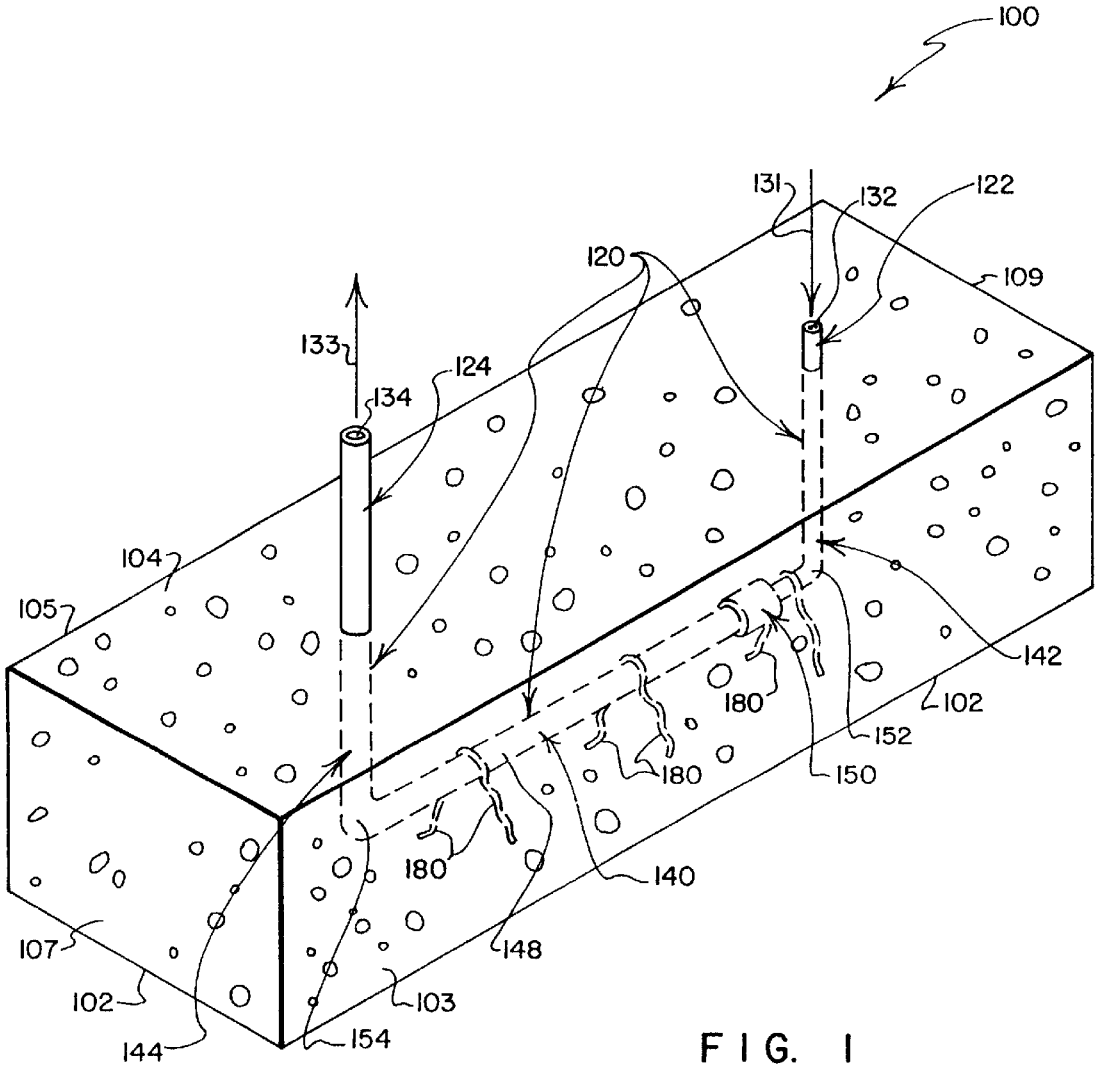
FIG. 1 is perspective view showing a generally rectangular block of cast refractory material of the type that may be used to form a component of a wall, door, lid, cover or other element of an industrial furnace or the like, including a U-shaped chimney-like cooling conduit having a central region embedded within the cast refractory material for providing thermal induced cooling, and having end regions projecting therefrom for defining inlet and outlet openings.

Referring to FIG. 1, portions of a typical cast refractory component of an industrial furnace wall, door, cover, lid or the like are indicated generally by the numeral 100. The cast refractory component segment 100 has an inner face 102, an outer face 104, opposed sides 103, 105, opposed ends 107, 109, and is of generally rectangular shape.

The use of cast refractory components of a wide variety of configurations is well known in industrial furnaces and the like. Patents that depict such components include several issued to the applicant herein, including U.S. Pat. Nos. 5,445,897, 5,483,548, 5,335,897 5,562,879, 5,575,970, 5,578,264, 5,681,525 and 5,756,043. The manner in which cast refractory components for industrial furnace typically are formed, and the character of the materials utilized to form such components are discussed in these patents, and forms no part of the present invention.

In accordance with the preferred practice of the present invention, the cast refractory segment 100 is provided with a generally U-shaped, chimney-like cooling conduit 120. The conduit 120 has an inlet end region 122 and an outlet end region 124 that extend substantially parallel to each other as they pass through the outer face 104. The outlet end region 124 extends to a greater height than the inlet end region 122, and defines an outlet opening 134 that is of a larger diameter than the inlet opening 132 that is defined by the inlet end region 122.

The conduit 120 also has a central region 140 that is embedded within the cast refractory segment. The central region has an inlet end region 142 and an outlet end region 144 that define right angle bends 152, 154, respectively. The inlet end regions 122, 142 are of a uniform diameter which is smaller than the uniform diameter of the outlet end regions 124, 144. The larger diameter of the outlet end region 144 extends along a base leg 148 of the conduit 120 to a location near the right angle bend 152 where a pipe coupling 150 is welded in place to connect and communicate the base leg 148 with the inlet end region 142.

By the arrangement just described, the conduit 120 defines a continuous, substantially unobstructed passage through which ambient air in the vicinity of the outer face 104 of the cast refractory component 100 can enter the inlet opening 132 (as indicated by the arrow 131) and travel through the inlet end regions 122, 142, the coupling 150, the central leg 148 and the outlet end regions 124, 144 to discharge through the outlet opening 134 (as indicated by the arrow 133).

To provide a something of a chimney-like arrangement that encourages ambient air to enter the inlet opening 132 and to discharge from the outlet opening 134, the outlet end region 124 positions the outlet opening 134 higher than the inlet end region 122 positions the inlet opening 132—so that the net effect of air flowing through the chimney-like conduit 120 will be that of an "updraft."

To encourage ambient air that becomes heated during its passage through the central region 140 (due to the relatively high temperature of the interior of the cast refractory component 100 when in service in an industrial furnace application or the like) to move toward discharging through the outlet opening 134 rather than through the inlet opening 132, the coupling 150 provides a transition from the relatively smaller diameter inlet end regions 122, 142 to the relatively larger diameter central leg 148 and outlet end regions 124, 144. Since air that is being heated (and thereby caused to expand in volume) within the central leg 148 will seek to move in the direction of least resistance, it will tend to move toward the relatively large diameter outlet end regions 124, 144 and toward the outlet opening 134 rather than toward the relatively smaller diameter (and hence relatively more restricted) diameter inlet end regions 122, 142 and the inlet opening 132.

The flow of ambient air through the conduit 120 (into the inlet opening 132 and out of the outlet opening 134) is an "induced flow"—induced by the chimney effect provided by the physical arrangement of the conduit 120 and by the thermal effect that causes air that is heated while within the conduit 120 to seek escape therefrom by the path of least resistance, namely through the outlet opening 134. Heated air expands, becomes less dense and hence lighter in weight per unit of volume and less drawn by gravity than the same unit of volume of denser, colder air; and, as the force of gravity draws colder air down to displace hotter air, hotter air is caused to rise.

The effect of the flow of ambient air through the chimney-like conduit 120 (during which flow, the air takes on heat energy from the walls of the central region 140 which is hot due to being exposed to the high temperature of the interior of the cast refractory component 100 during its service as an element of an industrial furnace or the like, not shown) is to take on heat energy—which process serves to cool the walls of the central region 140 of the conduit 120 which, in turn, serves to cool the interior of the cast refractory component 100.

Tests have shown that the greater the temperature difference between the interior of the cast refractory component 100 and the ambient air that enters the inlet opening 122, the more forceful is the flow of ambient air through the conduit 120. As the flow rate of ambient air through the conduit 120 increases (within reasonable limits), the greater is the capacity of the ambient air flow to take on heat energy and carry it away from the interior of the cast refractory component. While increases in flow rate beyond a certain point undoubtedly will provide very little increase in the ability of the flow to carry away additional heat energy from the cast refractory component 100, the rates at which ambient air is thermally induced to flow through the conduit 100 in the manner described above has not been found during tests to approach such limits.

In tests conducted to date, inlet end region internal diameters of about one-half inch have been utilized with outlet end region internal diameters of about one inch—and these tests have demonstrated success in reducing the internal temperature of cast refractory components of industrial furnaces from about 1500 degrees Fahrenheit to about 1200 degrees Fahrenheit. Because stainless steel will function with good service life longevity in operating temperatures of about 1200 degrees Fahrenheit but not in operating temperatures of about 1500 degrees Fahrenheit, tests have demonstrated the capability of the chimney-like conduits of the present invention to provide much more hospitable environments within which stainless steel embedded within castable refractory components of industrial furnaces can survive and perform its intended function.

Thus, the components of the conduit 120 preferably are formed from stainless steel. Also, stainless steel preferably is utilized to form other metallic structure that may need to be embedded within the cast refractory component 100, for example the anchor wires 180 that are depicted in FIG. 1 as extending away from the conduit 120 so as to reinforce portions of the component 100 within the vicinity of the conduit 120.

Having described various basic features of the method and means that is contemplated by the present invention for establishing thermal flows of ambient air through the interiors of components of industrial furnaces for purposes of cooling, examples will now be provided of a variety of simple ways in which features of the present invention can be utilized to cool various industrial furnace components. While the examples that follow utilize the chimney-like conduits of the present invention to cool furnace components that are made of so-called "castable refractory materials" (such as are described in the patents referenced above), it will be understood by those who are skilled in the art that features of the invention can be used to cool a wide variety of other types of components of industrial furnaces and the like.

Figure 2:
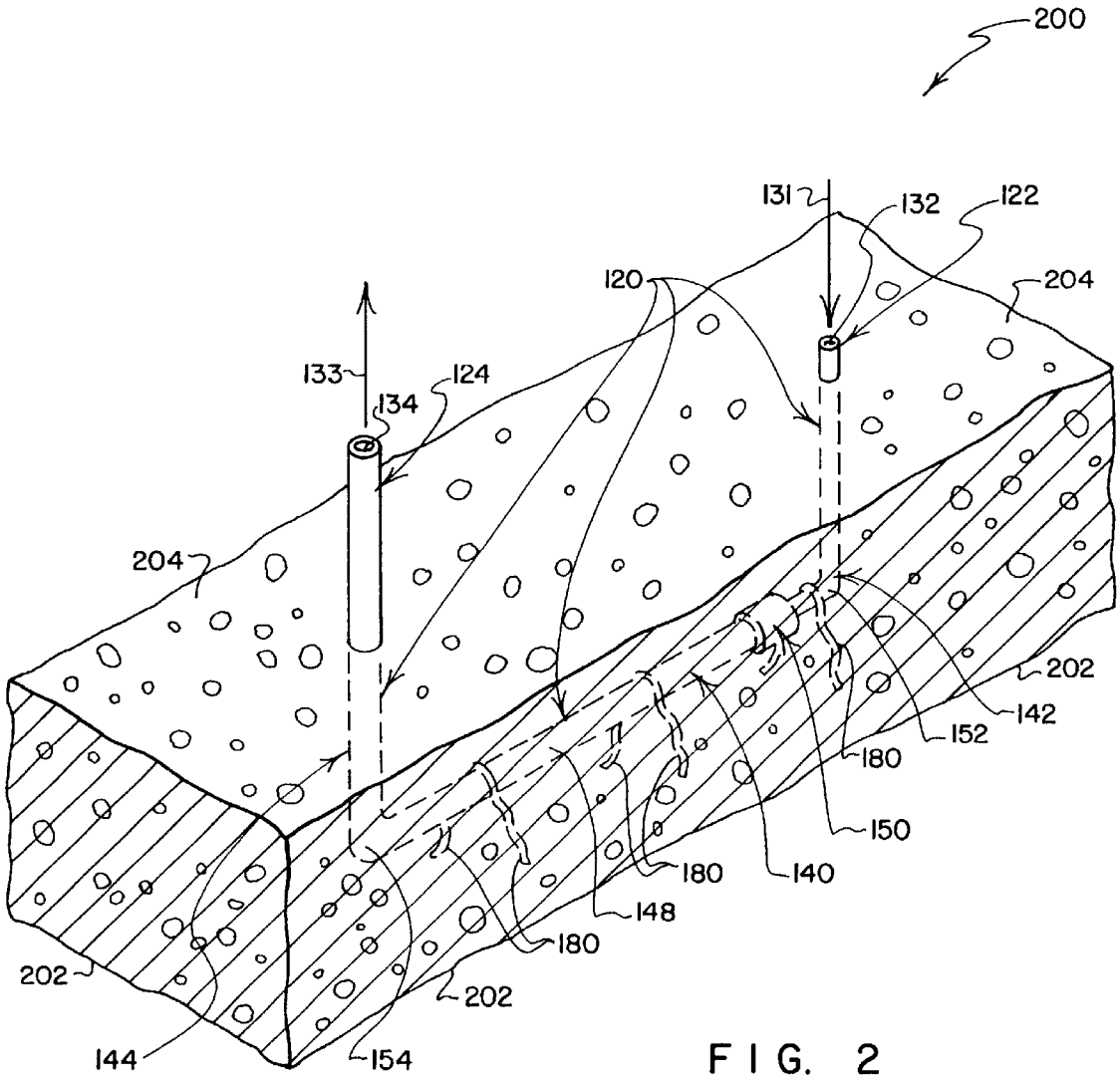
FIG. 2 is a perspective view showing a generally rectangular region of a cast refractory component of a wall, door, lid, cover or other element of an industrial furnace or the like, including a U-shaped chimney-like cooling conduit having a central region embedded within the cast refractory material for providing thermal induced cooling, and having end regions projecting therefrom for defining inlet and outlet openings.

Referring to FIG. 2, a typical segment 200 of an industrial furnace wall, door, cover, lid or the like is shown that has an inner face 202 and an outer face 204, but no shown borders (i.e., no opposed side or end walls). The purpose of this depiction is simply to confirm that the chimney-like cooling conduit 120 (which is depicted in FIG. 2 using the same numerals that are used in FIG. 1 to designate corresponding elements thereof) can be used to cool cast refractory component regions of substantially any desired size and shape.

Figure 3:
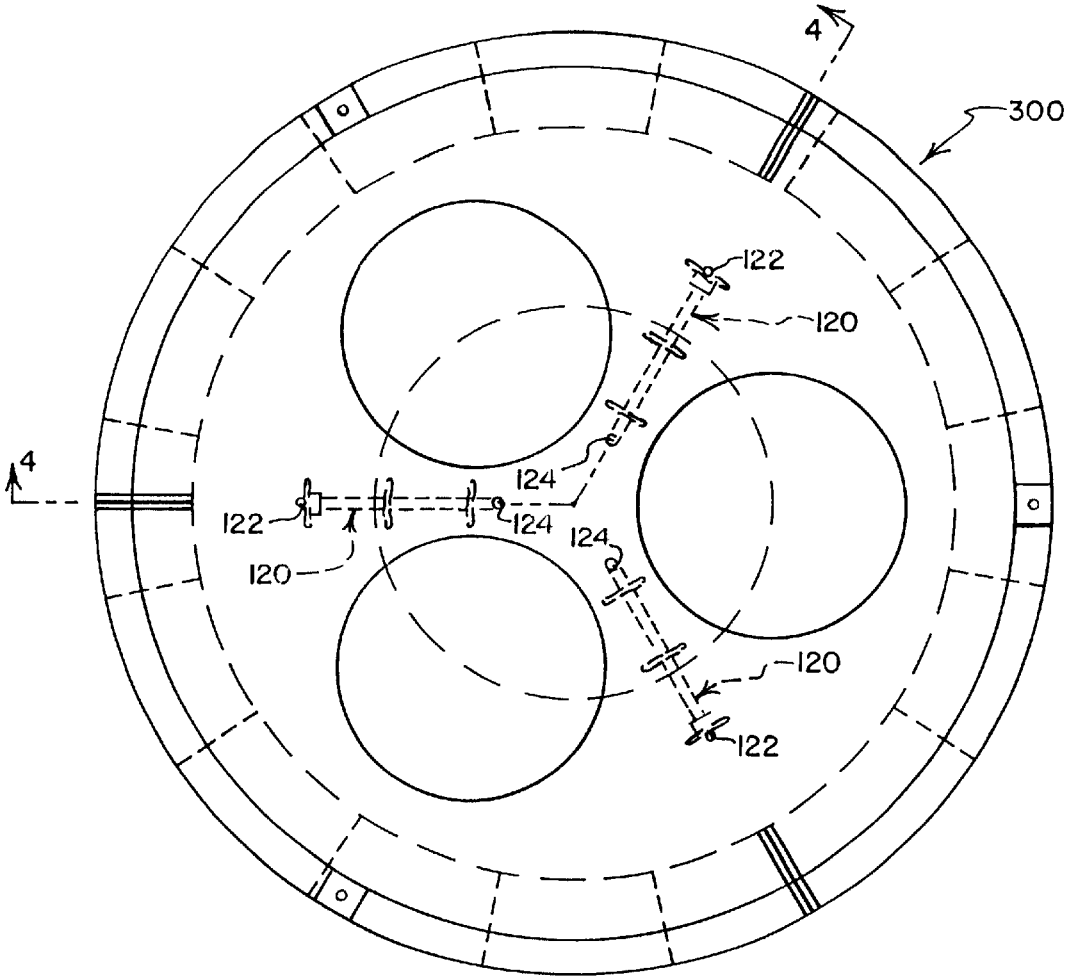
FIG. 3 is a top plan view of a lid or cover for an industrial furnace or the like, with three typical locations of U-shaped chimney-like cooling conduits being depicted principally by hidden lines.
Figure 4:
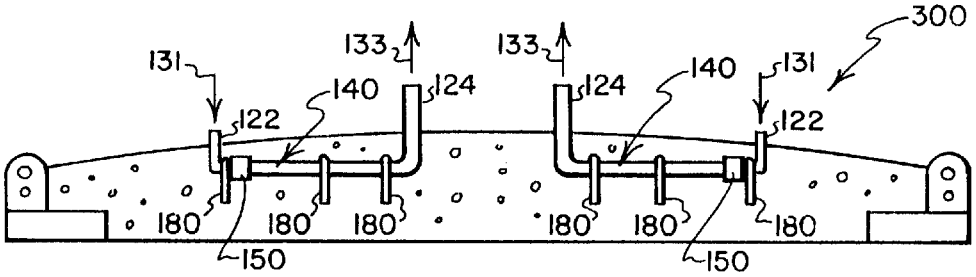
FIG. 4 is a sectional view as seen from planes indicated by the broken line 4—4 in FIG. 3.

Referring to FIGS. 3 and 4, a furnace lid or cover is indicated generally by the numeral 300 that incorporates three of the chimney-like conduits 120 at selected locations therein. The purpose of this depiction is to confirm that almost any region of an industrial furnace wall, door, cover, lid or the like can be provided with the chimney-like conduits 120 for purposes of cooling.

Figure 5:
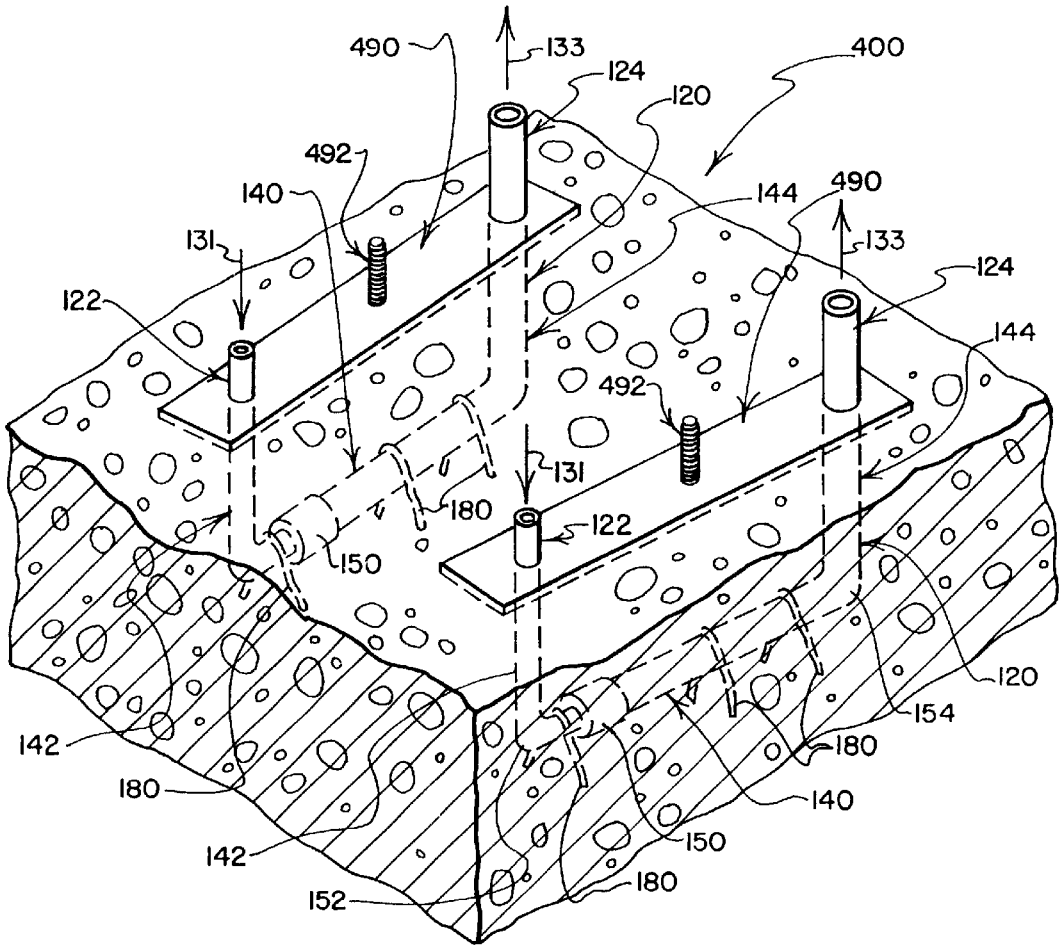
FIG. 5 is a perspective view showing a generally rectangular region of a cast refractory component of a wall, door, lid, cover or other element of an industrial furnace or the like, including a pair of U-shaped conduits having central regions embedded therein, for providing thermal induced cooling of the component, and having end regions projecting therefrom for defining inlet and outlet openings.

Referring to FIG. 5, another cast refractory segment of indefinite size is indicated by the numeral 400 which has two of the chimney-like conduits 120 installed therein at spaced locations, with mounting plates 490 that carry threaded studs 492 being welded to the inlet and outlet end regions 122, 124. In this embodiment, the mounting plates 490 and the studs 492 provide structure that can be connected to a steel framework to position the cast refractory segment 400 for use in an industrial furnace —and the connection that is formed with the cast refractory material by embedding the chimney-like conduits 120 and the anchor wires 180 therein enables the chimney-like conduits 120 to serve as self-cooled anchors to the refractory—anchors that will exhibit lengthy service lives because they will function to keep themselves cool enough to avoid significant thermal deterioration when the cast refractory within which they are embedded is heated to high temperatures during use.

Figure 6:
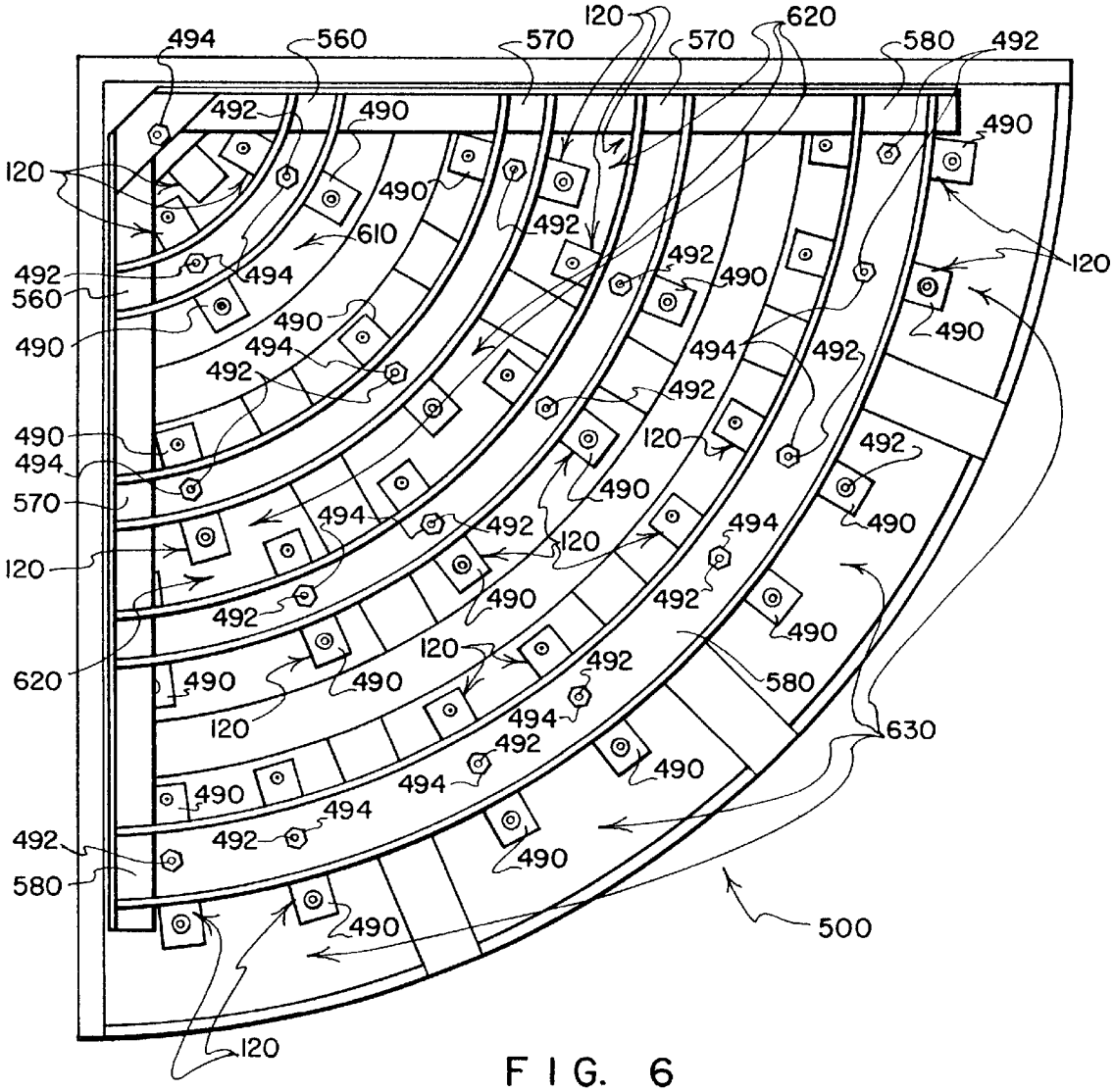
FIG. 6 is a top plan view of a "quarter" assembly of a lid or cover of an industrial furnace or the like wherein innermost, central and outermost "rings" of cast refractory components are employed, it being understood that the component portions depicted in FIG. 5 find corresponding portions in each of the components of the innermost, central and outermost "rings;"

Referring to FIG. 6, a quarter-circle assembly 500 of an industrial furnace cover is depicted that employs a plurality of tapered arcuate cast refractory segments 610, 620, 630 to define its quarter-circle shape. The segments 610, 620 each have three of the chimney-like conduits 120 embedded therein, while the segments 630 each have two of the chimney-like conduits 120 embedded therein, with each of the conduits 120 having mounting plates 490 welded thereto (in the manner depicted in FIG. 5) to provide threaded studs 492 for connecting the segments 610, 620, 630 to a welded steel framework 550 of the cover 500.

As depicted in FIG. 6, the segments 600 include an inner quarter-circle segment 610, a curved row of three central segments 620, and a curved row of four outer segments 630. The steel framework 550 includes a curved inner channel member 560 that overlies the inner segment 610, two curved channel members 570 that overlie the central segments 620, and a curved outer channel member 580 that overlies the outer segments 630—together with other structural steel work that defines a quarter-circle frame for supporting the channel members 560, 570, 580. The threaded studs 492 extend through holes formed in the channel members 560, 570, 580 and are held in placed by nuts 494 that are threaded onto the studs 492.

Figure 7:
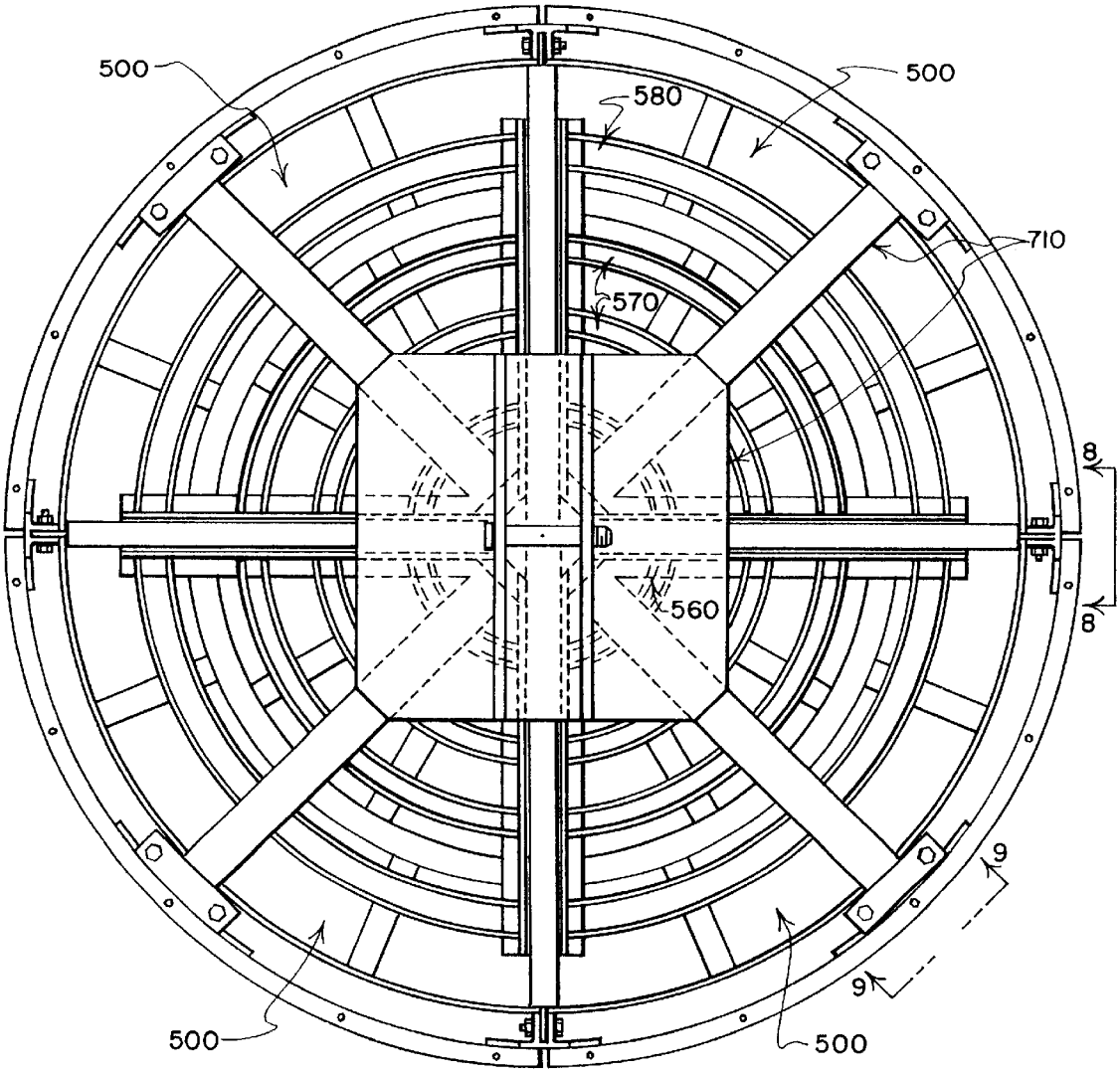
FIG. 7 is a top plan view of a lid or cover of an industrial furnace or the like that employs four of the "quarter" assemblies of FIG. 6.
Figure 8:
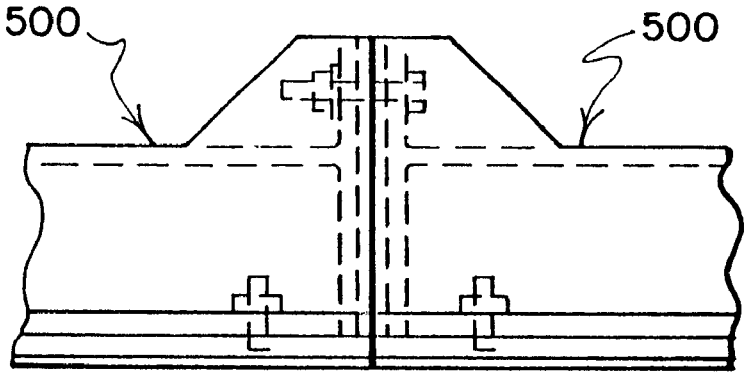
FIGS. 8 and 9 are side elevational views, on an enlarged scale, of portions of the lid or cover of FIG. 7, as seen from planes indicated by lines 8—8 and 9—9 in FIG. 7, respectively.
Figure 9:
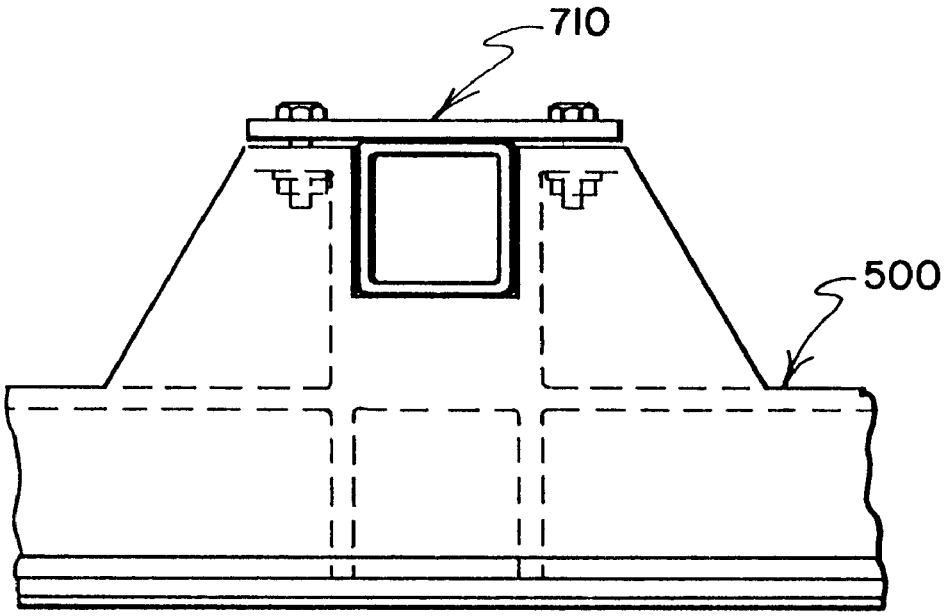
Figure 10:
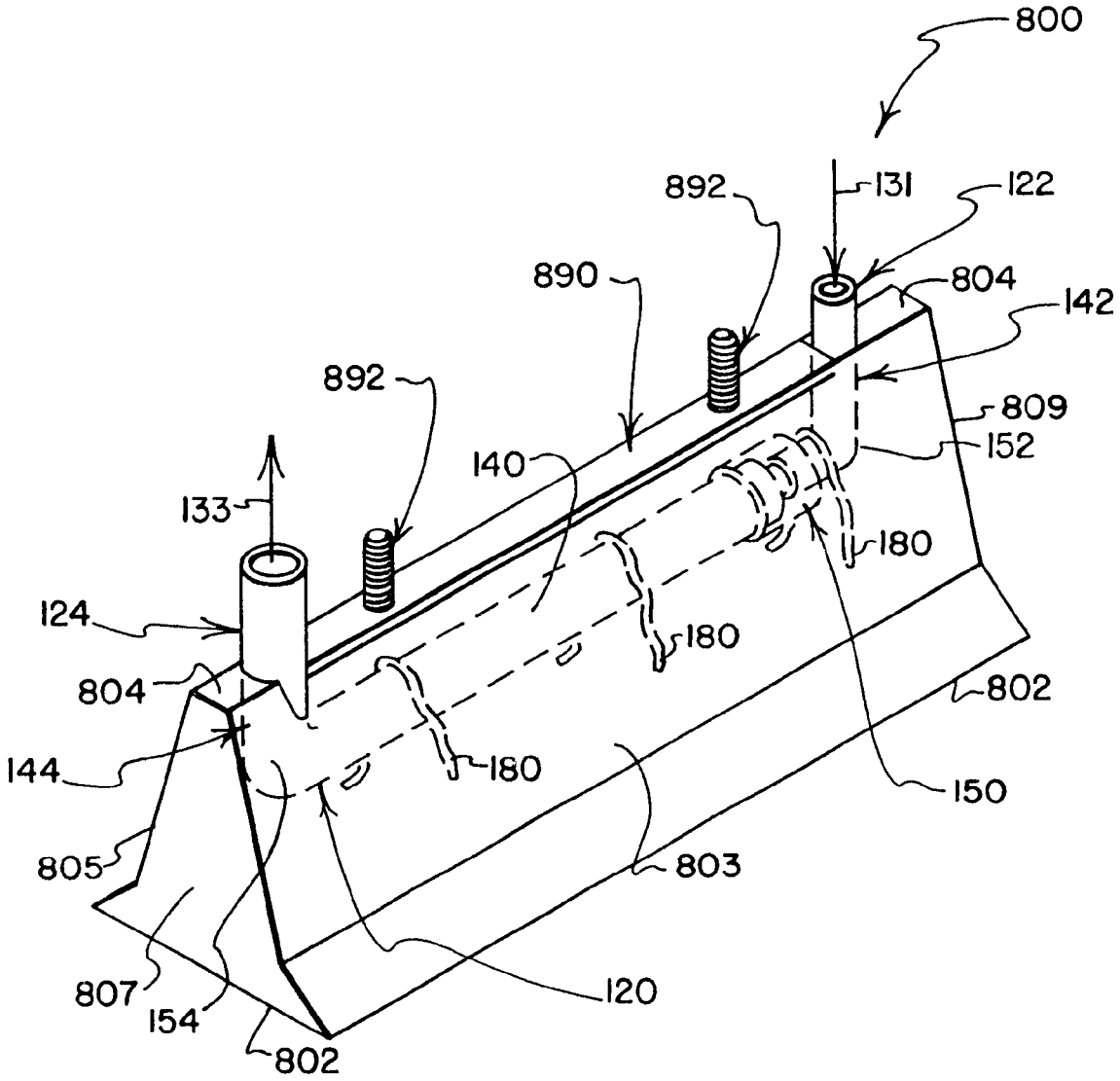
Figure 11:
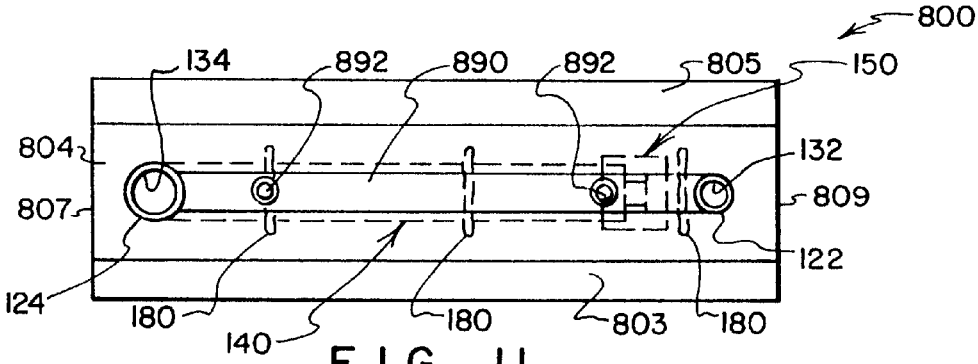
FIG. 11 is a top plan view thereof.
Figure 12:
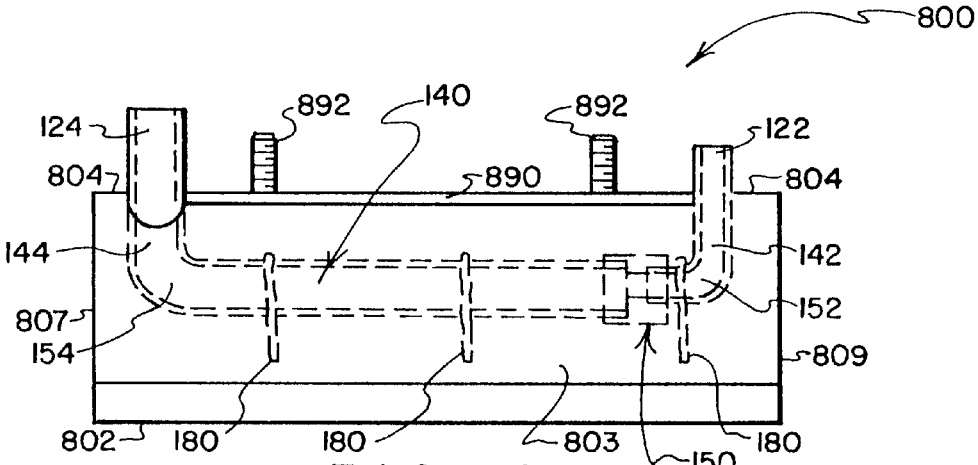
FIG. 12 is a side elevational view thereof.
Figure 13:
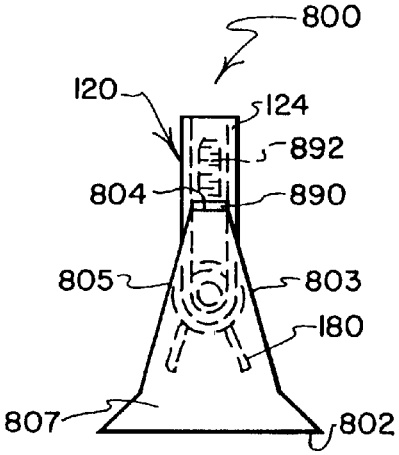
FIG. 13 is an end elevational view thereof.

The manner in which four of the quarter circle assemblies 500 can be assembled to form a circular lid or cover 700 for an industrial furnace is depicted in FIG. 7. Features of a steel frame 710 of the cover 700 are depicted in FIGS. 8 and 9—it being noted in FIG. 8 that adjacent assemblies 500 can be connected by being bolted together, with FIG. 9 illustrating that portions of the upper framework 710 of the cover 700 also can be bolted to the quarter circle assemblies 500 so that the quarter circle assemblies 500 can be removed and replaced from the cover 700 if damaged.

Referring to FIGS. 10–13, an elongate cast refractory segment of a type used in an industrial furnace door is indicated generally by the numeral 800. The segment 800 has an inner face 802, an outer face 804, opposed end walls 807, 809, and side walls 803, 805 that taper to give the segment 800 a generally V-shaped or generally T-shaped cross section. The segment 800 also has one of the chimney-like conduits 120 embedded therein, with its inlet and outlet end regions 122, 124 projecting through the outer face 804. The segment 800 has a steel plate 890 welded to the inlet and outlet end regions 122, 124 of the conduit 120. The steel plate 890 carries two threaded mounting studs 892 for mounting the segment 800 on a suitably configured steel support frame.

Figure 15:
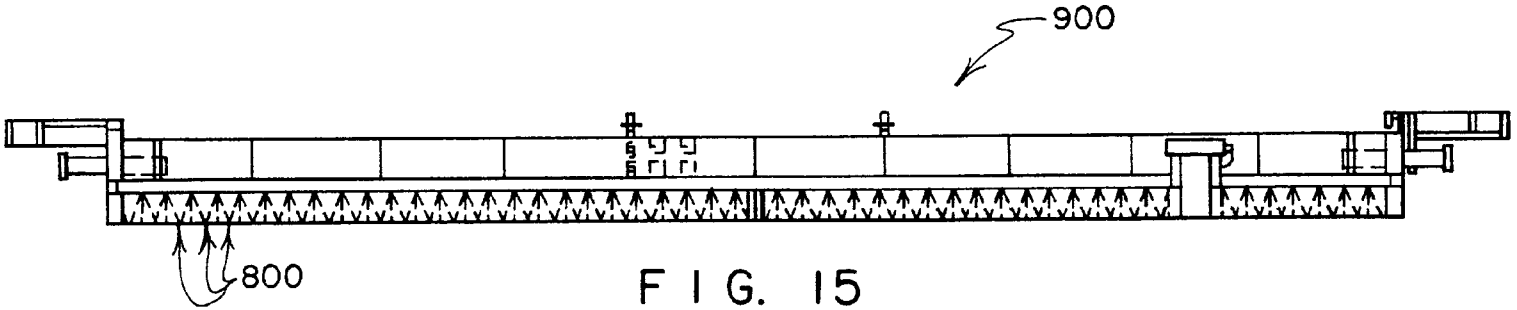
Figure 14:
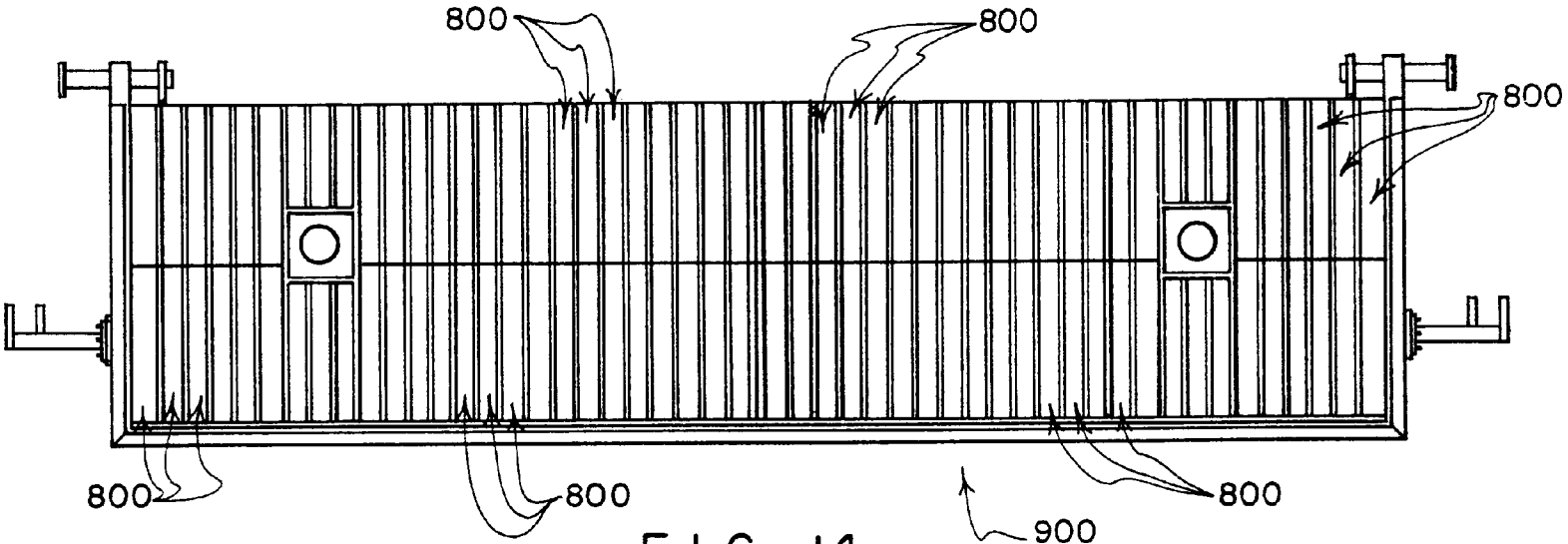
FIG. 14 is a front elevational view of a door of an industrial furnace that utilizes segments of the type shown in FIGS. 10–13; and, FIG. 15 is a top plan view thereof.

The advantages of V-shaped and T-shaped cross-sections are discussed in applicant's U.S. Pat. Nos. 5,335,897 and 5,483,548, the disclosures of which are incorporated herein by reference. While these two referenced patents show some of the ways in which V-shaped or T-shaped segments can be employed in furnace doors, walls and the like, still another arrangement of segments of this type to form a furnace door 900 is depicted in FIGS. 14 and 15. The door 900 utilizes a top row 910 and a bottom row of the segments 800, with all of the segments extending substantially vertically in closely spaced, side-by-side relationships.

While the cooling passages in the examples described above all are defined by generally U-shaped metal conduits having opposite end regions that extend substantially parallel to open through a common cold face of a heated component of an industrial furnace or the like, it will be readily understood by those who are skilled in the art that modifications can be made without departing from the scope and spirit of the invention. End regions of the passages need not open through a common face in order to provide outlet openings located above inlet openings so that chimney-like passages are defined. Plural inlet and/or outlet openings can be used with a single passage while still providing all of the outlet openings at locations above the inlet openings so that chimney-like passages are defined. Y-shaped and other forms of branched passages may be employed. And, if enlargements in cross-sectional area are to be employed to encourage heated gases to discharge through outlets of larger area than inlets, increases in diameter can be provided at a plurality of locations along the length of a single passage, or by use of one or more tapered passage lengths.

If some of the changes and variations mentioned above are found to be old in the art, this does not mean that others are "obvious." For example, it represents quite an interesting discovery that U-shaped conduits that have both end regions opening upward, with a central connecting region that extends horizontally, can in fact cause a cooling flow to self establish therethrough if its outlet is positioned above its inlet—and this is not at all obvious if one already knows that conduits having vertically oriented central regions will provide a similar sort of cooling function. Likewise, providing conduits with increases in diameter to facilitate the establishment and maintenance of correctly directed flows also offers an improvement that some might say is unexpected. And, the overall concept of utilizing conduits to self-establish cooling flows when components become heated, and to provide flows that increase in cooling capacity as their associated components become increasingly heated represents a significant step forward in an art where prior efforts to provide cooling principally have employed complex forced flow apparatus. Further, the utilization of cooling conduits to provide self-cooling mounts for cast refractory components used in high heat environments is not taught or suggested by the prior art and represents a significant advance.

Thus, while the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention. It is intended that the patent shall cover, by suitable expression in the appended claims, whatever features of patentable novelty reside in the invention disclosed.

What is claimed is:

1. A method of cooling a component formed from cast refractory material having two faces that, during use, is subjected to high heat on one face thereof, comprising the steps of:

a) providing at least one passage through the interior of the cast refractory material component that extends continuously between spaced openings located near opposite ends of the passage and which are on the other face of the component; and, b) positioning the cast refractory material component so that, when the component is subjected to heat on the one face thereof during use, the spaced openings are at differing vertical levels and communicate with a body of relatively cooler ambient air at the other face, with at least one of the openings defining an inlet to the passage that is located below at least another of the openings defining an outlet to the passage, so that ambient air may enter the passage inlet, may become convectively heated and rise upwardly through the said at least one passage in the absence of any mechanical inducement to air flow, and may discharge from the passage outlet, thereby to establish a flow of ambient air through the passage to cool the component as it is heated on the one face thereof.

2. The method of claim 1 wherein the step of providing at least one passage includes the steps of forming a metal conduit to define the at least one passage, and installing the metal conduit to extend through the interior of the component.

3. The method of claim 2 wherein the step of forming a metal conduit includes the step of configuring the conduit to define the at least one passage in a U-shaped configuration.

4. The method of claim 3 wherein the step of configuring the conduit includes the steps of providing two generally L-shaped conduit portions that each have a pair of legs extending substantially at right angles that are connected by right-angle bends, aligning one leg of each of the conduit L-shaped conduit portions, and forming a connection between the aligned one legs to communicate the interior of one of the L-shaped conduit portions with the interior of the other of the L-shaped conduit portions.

5. The method of claim 4 wherein the step of forming a connection includes the step of positioning end regions of each of the aligned one legs to extend into opposite ends of a coupling, and welding the end regions, so positioned, to the coupling.

6. The method of claim 2 wherein the step of installing the metal conduit includes the steps of:

a) providing a mold that defines the exterior shape of the component;

b) positioning the metal conduit so that a central region of the metal conduit extends through a central region of a mold; and, c) pouring castable refractory material into the mold to form the component with the central region of the metal conduit embedded in and extending through the interior of the component.

7. The method of claim 6 wherein the step of positioning the component includes the step of connecting the component to a supporting frame to hold the component in position with the inlet located below the outlet.

8. The method of claim 7 wherein the step of connecting the component to a supporting frame includes the step of connecting at least one end region of the metal conduit to the supporting frame.

9. The method of claim 2 wherein the step of forming a metal conduit includes the step of providing the outlet with a larger cross-sectional area than the inlet.

10. The method of claim 2 wherein the step of positioning the component includes the step of connecting the component to a supporting frame to hold the component in position with the inlet located below the outlet.

11. The method of claim 10 wherein the step of providing at least one passage includes the steps of forming a metal conduit to define the at least one passage, and installing the metal conduit to extend through the interior of the component, and wherein the step of connecting the component to a supporting frame includes the step of connecting at least one end region of the metal conduit to the supporting frame.

12. The method of claim 10 wherein the step of providing at least one passage includes the steps of forming a plurality of metal conduits to define a plurality of passages, and installing the metal conduits to extend in spaced relationship through the interior of the component, and wherein the step of connecting the component to a supporting frame includes the step of connecting at least one end region of at least one of the metal conduits to the supporting frame.

13. A method of cooling a component formed from cast refractory material having two faces that becomes heated to temperatures well above ambient temperature during use with a self-cooling capability that occurs when the component is subjected to heat on one face thereof, and that provides additional cooling as the component becomes hotter, comprising the steps of a) providing at least one passage through the interior of the cast refractory material component that extends continuously between spaced inlet and outlet openings located near opposite ends of the passage and which are on the other face of the component; and, b) positioning the cast refractory material component with the outlet opening located above the inlet opening so that, when the component is subjected to heat on the one face thereof during use, the spaced openings communicate with a body of relatively cooler ambient air at the other face of the component to permit ambient air to enter the inlet opening, to become convectively heated and rise upwardly through the said at least one passage in the absence of any mechanical inducement to air flow, and to discharge from the passage outlet opening, thereby to establish a flow of cooler ambient air through the passage to cool the component as it is heated on the one face thereof, with the rate of said flow increasing as the temperature of the component increases while being subjected to heat on one face thereof during use.

14. The method of claim 13 wherein the step of providing at least one passage includes the steps of forming a metal conduit to define the at least one passage, and installing the metal conduit to extend through the interior of the component.

15. The method of claim 14 wherein the step of forming a metal conduit includes the step of configuring the conduit to define the at least one passage in a U-shaped configuration.

16. The method of claim 15 wherein the step of configuring the conduit includes the steps of providing two generally L-shaped conduit portions that each have a pair of legs extending substantially at right angles that are connected by right-angle bends, aligning one leg of each of the conduit L-shaped conduit portions, and forming a connection between the aligned one legs to communicate the interior of one of the L-shaped conduit portions with the interior of the other of the L-shaped conduit portions.

17. The method of claim 16 wherein the step of forming a connection includes the step of positioning end regions of each of the aligned one legs to extend into opposite ends of a coupling, and welding the end regions, so positioned, to the coupling.

18. The method of claim 14 wherein the step of installing the metal conduit includes the steps of:

a) providing a mold that defines the exterior shape of the component;

b) positioning the metal conduit so that a central region of the metal conduit extends through a central region of a mold; and, c) pouring castable refractory material into the mold to form the component with the central region of the metal conduit embedded in and extending through the interior of the component.

19. The method of claim 18 wherein the step of positioning the component includes the step of connecting the component to a supporting frame to hold the component in position with the inlet located below the outlet.

20. The method of claim 19 wherein the step of connecting the component to a supporting frame includes the step of connecting at least one end region of the metal conduit to the supporting frame.

21. The method of claim 14 wherein the step of forming a metal conduit includes the step of providing the outlet with a larger cross-sectional area than the inlet.

22. The method of claim 14 wherein the step of positioning the component includes the step of connecting the component to a supporting frame to hold the component in position with the inlet located below the outlet.

23. The method of claim 22 wherein the step of providing at least one passage includes the steps of forming a metal conduit to define the at least one passage, and installing the metal conduit to extend through the interior of the component, and wherein the step of connecting the component to a supporting frame includes the step of connecting at least one end region of the metal conduit to the supporting frame.

24. The method of claim 22 wherein the step of providing at least one passage includes the steps of forming a plurality of metal conduits to define a plurality of passages, and installing the metal conduits to extend in spaced relationship through the interior of the component, and wherein the step of connecting the component to a supporting frame includes the step of connecting at least one end region of at least one of the metal conduits to the supporting frame.

25. A method of providing a self-cooling mount for a cast refractory component of an industrial furnace, comprising the steps of:

a) providing a mold having an interior that defines the desired exterior configuration of at least a portion of the component;

b) positioning a metal conduit so that a central region of the conduit extends through a central region of the mold, and so that opposite ends of the metal conduit, which respectively define an inlet and an outlet, extend beyond the desired exterior configuration defined by the mold:

c) pouring castable refractory material into the mold to form the component with the central region of the conduit establishing a gaseous coolant flow passage that extends interiorly through the component; and, d) positioning the component with the metal conduit therein so that, when the component is subjected to significant heat during use, the outlet is positioned to communicate with a body of ambient air at a location above where the inlet communicates with the body of ambient air so that as ambient air is heated in the conduit central region and rises, ambient air may enter the lower-positioned inlet may become heated and rise through the central region, in the absence of any mechanical inducement to air flow and may discharge from the outlet, thereby to establish a flow of coolant ambient air through the flow passage to cool the component as it is heated during use.

26. The method of claim 25 wherein the step of positioning a metal conduit includes the steps of configuring the metal conduit to define the coolant flow passage to include a U-shaped configuration.

27. The method of claim 26 wherein the step of configuring the conduit includes the steps of providing two generally L-shaped conduit portions that each have a pair of legs extending substantially at right angles that are connected by right-angle bends, aligning one leg of each of the conduit L-shaped conduit portions, and forming a connection between the aligned one legs to communicate the interior of one of the L-shaped conduit portions with the interior of the other of the L-shaped conduit portions.

28. The method of claim 27 wherein the step of forming a connection includes the step of positioning end regions of each of the aligned one legs to extend into opposite ends of a coupling, and welding the end regions, so positioned, to the coupling.

29. The method of claim 25 wherein the step of positioning the component includes the step of connecting the component to a supporting frame to hold the component in position with the inlet located below the outlet.

30. The method of claim 29 wherein the step of connecting the component to a supporting frame includes the step of connecting at least one end region of the metal conduit to the supporting frame.

31. The method of claim 26 wherein the step of configuring the metal conduit includes the step of providing the outlet with a larger cross-sectional area than the inlet.

32. The method of claim 25 wherein the step of positioning the component includes the step of connecting the component to a supporting frame to hold the component in position with the inlet located below the outlet.

33. The method of claim 32 wherein the step of connecting the component to a supporting frame includes the step of connecting at least one end region of the metal conduit to the supporting frame.

34. A self-cooling component for installation in a highly heated environment including a body formed from cast refractory material and having two sides and having a passage formed interiorly therethrough that extends continuously from an inlet to an outlet that is located above the inlet when the component is installed for use in the highly heated environment, wherein one side of the component is proximate the highly heated environment and the inlet and the outlet are on another side of the component and opening to a body of the ambient air that many enter the inlet, which air may become heated by the highly heated environment on the one side of the component and convectively rise through said passage in the complete absence of any mechanical inducement to air flow, and may discharge from the outlet, thereby to establish a continuous flow of relatively cooler ambient air through the passage to cool the component when the component becomes heated.

35. The self-cooling component of claim 34 wherein the outlet has a larger cross-sectional area than the inlet.

36. The self-cooling component of claim 34 wherein the passage is defined, at least in part, by a metal conduit.

37. The self-cooling component of claim 36 wherein the conduit has at least one end region that extends from the body and can be connected to a supporting framework to at least assist in mounting the body on the supporting framework.

38. The self-cooling component of claim 36 wherein the conduit defines the entire passage and extends continuously between the inlet to the outlet.

39. The self-cooling component of claim 38 wherein the conduit ha s opposed end regions that extend from the body at s paced locations that can be connected to a supporting framework to at least assist in mounting the body on the supporting framework.

40. The self-cooling component of claim 38 wherein the conduit defines a generally U-shaped passage.

41. A self-cooled component formed from cast refractory material that, during use, is subjected to significant heat, having at least one passage through the interior of the component that extends continuously between spaced openings located near opposite ends of the passage, and that is mountable on a supporting framework so that, when the component is subjected to significant heat during use, the spaced openings communicate with a body of ambient air not subjected to the significant heat, with at least one of the openings defining an inlet that is located below at least another of the openings defining an outlet so that ambient air may enter the inlet, may become heated in the said at least one passage, and rise by convection and without mechanical inducement through said at least one passage, and may discharge from the outlet, thereby establishing a continuous flow of ambient air through the passage to cool the component and extend the life thereof.

42. The self-cooled component of claim 41 wherein the outlet is of greater cross-sectional area than the inlet.

43. The self-cooled component of claim 41 wherein the passage is defined along its full length by a metal conduit.

44. The self-cooled component of claim 43 wherein the passage defined by the conduit is of generally U-shaped configuration.

45. The self-cooled component of claim 44 wherein the conduit is formed from two generally L-shaped conduit portions that each have a pair of legs extending substantially at right angles that are connected by right-angle bends, with one leg of each of the L-shaped conduit portions extending in alignment and being connected to communicate the interior of one of the L-shaped conduit portions with the interior of the other of the L-shaped conduit portions.

46. The self-cooled component of claim 45 wherein one of the L-shaped conduit portions defines the outlet, the other of the L-shaped conduit portions defines the inlet, the outlet is of larger cross-sectional area than the inlet.

47. An element of an industrial furnace formed from a plurality of components supported by a frame, wherein at least one of the components is formed from cast refractory material, said component having a relatively cold face and a relatively hot face when in use, and the component further having a central region of a metal conduit embedded therein, wherein the conduit has opposed inlet and outlet end regions that open through the cold face of the component to a body of ambient air, wherein the component is positioned during use with the outlet end region located above the inlet end region to permit ambient air to enter the inlet end region, to become heated and convectively rise through the central region, and to discharge from the outlet end region in the absence of any mechanical inducement to air flow, thereby to establish a flow of relatively cooler ambient air through the conduit to cool the component, with the rate of air flow increasing as the temperature of the component increases while being subjected to heat during the use at the relatively hot face.

48. The element of claim 47 wherein the outlet is of greater cross-sectional area than the inlet.

49. The element of claim 47 wherein the passage is defined along its full length by a metal conduit.

50. The element of claim 49 wherein the passage defined by the conduit is of generally U-shaped configuration.

51. The element of claim 50 wherein the conduit is formed from two generally L-shaped conduit portions that each have a pair of legs extending substantially at right angles that are connected by right-angle bends, with one leg of each of the L-shaped conduit portions extending in alignment and being connected to communicate the interior of one of the L-shaped conduit portions with the interior of the other of the L-shaped conduit portions.

52. The element of claim 51 wherein one of the L-shaped conduit portions defines the outlet, the other of the L-shaped conduit portions defines the inlet, the outlet is of larger cross-sectional area than the inlet.

53. A structure that is exposed to a heated environment and has an interior face that becomes significantly heated during use and an opposite relatively cold face exposed to ambient air, wherein the structure is formed from a plurality of components, with at least one of the components including a body formed from cast refractory material having a passage formed interiorly therethrough that extends continuously from an inlet of the passage to an outlet of the passage that is located above the inlet when the component is installed for use in the heated environment, and, with another component including metallic structures embedded within the cast refractory component, wherein the inlet and the outlet both opening through the cold face and communicating with the body of ambient air so that ambient air may center the inlet, may become heated and rise convectively through said passage, and may discharge from the outlet in the absence of any mechanical inducement to air flow to thereby establish a flow of ambient air through the passage to cool the refractory and metallic components when the components becomes heated, thereby significantly extending the useful lives of the components in a significantly heated environment.

54. The structure of claim 53 wherein the outlet has a larger cross-sectional area than the inlet.

55. The structure of claim 53 wherein the passage is defined, at least in part, by a metal conduit.

56. The structure of claim 55 wherein the conduit has at least one end region that extends from the body and can be connected to a supporting framework to at least assist in mounting the body on the supporting framework.

57. The structure of claim 55 wherein the conduit defines the entire passage and extends continuously between the inlet to the outlet.

58. The structure of claim 57 wherein the conduit has opposed end regions that extend from the body at spaced locations that can be connected to a supporting framework to at least assist in mounting the body on the supporting framework.

59. The structure of claim 57 wherein the conduit is of generally U-shape and defines the passage as being of generally U-shape.

60. The structure of claim 59 wherein the outlet is of greater cross-sectional area than the inlet.

* * * * *